United States Patent [19]

Tsukamoto et al.

[11] Patent Number: 4,672,830

[45] Date of Patent: Jun. 16, 1987

[54] METHOD OF CONTROLLING AN EDGING OPENING IN A ROLLING MILL

[75] Inventors: Hidehiko Tsukamoto; Eiji Kohmoto, both of Hiroshima; Koichi Asada, deceased, late of Kur, by Kuniko Asada, legal representative; Masakuni Yamasaki, Kure; Kenichi Matsumoto, Kure; Euji Nakazono, Kure; Yoshinori Wakamiya, Kobe; Satoru Kuramoto, Kobe, all of Japan

[73] Assignees: Mitsubishi Jukogyo Kabushiki Kaisha; Mitsubishi Denki Kabushiki Kaisha, both of Tokyo, Japan

[21] Appl. No.: 739,390

[22] Filed: May 30, 1985

[30] Foreign Application Priority Data

May 30, 1984 [JP] Japan ..... 59-108433

[51] Int. Cl.[4] ..... B21B 37/00

[52] U.S. Cl. ..... 72/8; 72/14; 72/16; 72/199; 72/235; 364/472

[58] Field of Search ..... 72/199, 235, 234, 16, 72/8, 14, 365, 366; 364/472

[56] References Cited

U.S. PATENT DOCUMENTS 4,346,575 8/1982 Shibahara et al. ..... 72/234 X

FOREIGN PATENT DOCUMENTS 0109510 7/1982 Japan ..... 72/235

0066912 4/1984 Japan ..... 72/366

*Primary Examiner*—Robert L. Spruill

*Assistant Examiner*—Steve Katz

*Attorney, Agent, or Firm*—Toren, McGeady & Associates

[57] ABSTRACT

A method of controlling an edging opening in a rolling mill, comprising measuring a width distribution of a plate to be rolled at an inlet of an edging roll in the rolling mill, calculating beforehand a width deviation distribution and a length in the moving direction of the plate at an irregular deformation portion caused in a rolling process in accordance with a predetermined pass schedule and a target width deviation distribution of the rolled plate required at an outlet of the rolling mill, calculating an optimum edging opening variation distribution using a plate width adjustment efficiency calculated on the basis of the beforehand calculated value and supplying the optimum edging opening variation distribution to an edging opening setting unit for the feedforward control.

2 Claims, 5 Drawing Figures

Figure 1:
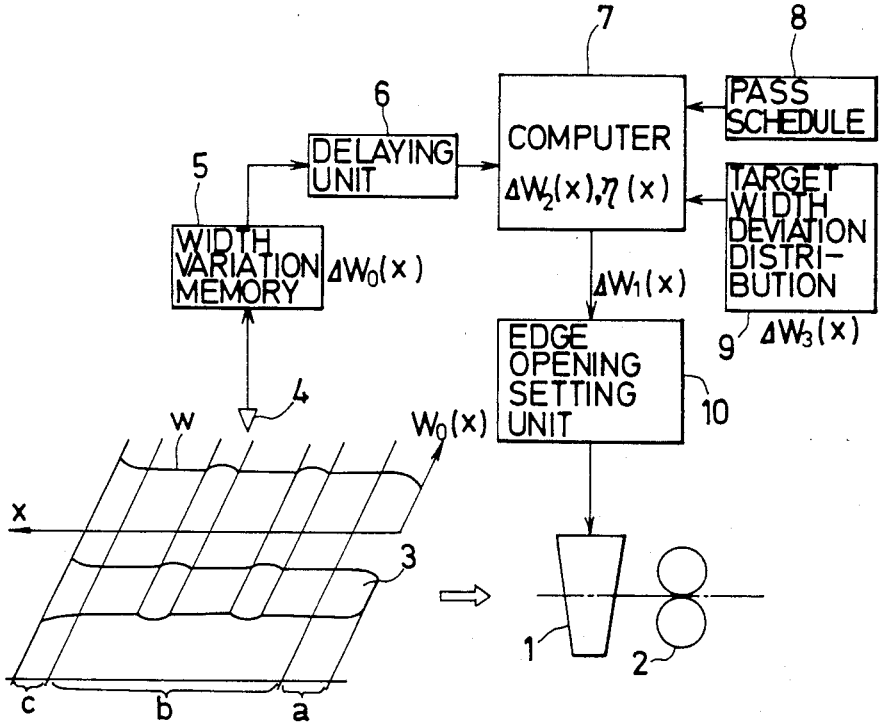

FIG.2 (A)
FIG.2 (B)
FIG.2 (C)
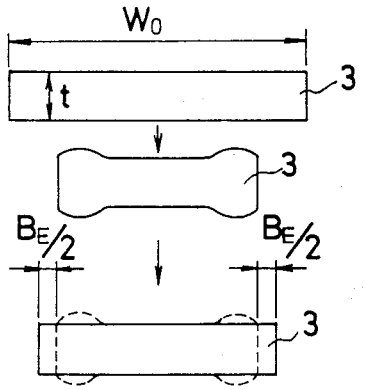
FIG.3
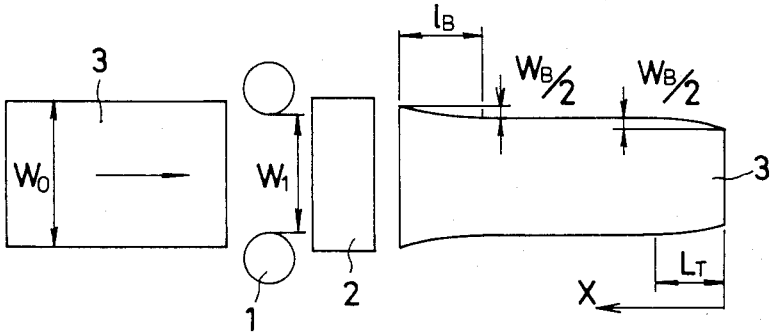

METHOD OF CONTROLLING AN EDGING OPENING IN A ROLLING MILL

The present invention relates to a method of controlling a width of a plate in plate rolling.

In recent years, the process of manufacturing slabs in hot rolling facilities for thin plates has changed rapidly from prior art ingot rolling to continuous rolling due to the required improvement in productivity and the saving of energy. However, as compared with the ingot rolling process in which it is relatively easy for slabs of any size to be fed for a target finishing width, various sizes of slab sizes must be fed only in stages in the continuous rolling process. Therefore, a large scale rolling process for determining a width of a rolled plate is required in a rough rolling process as compared with the prior art.

However, when such a large scale rolling or a horizontal rolling is carried out, it is known that notable irregular deformation portions, such as fishtails, are produced at a leading edge and a trailing edge of the plate and such portions prevent the improvement of yield. Further, variation or deviation of the plate width from a target width is producd at regular deformation portions due to a skid mark and the magnitude thereof can not be neglected.

In the past to prevent the irregular deformation portions at the leading edge and the trailing edge of the plate, it has been proposed beforehand to control the edging opening based on an equation which is previously obtained from experimental data (for example, Japanese Patent Application Laid-Open No. 69556/79). The control quantity in the conventional manner is previously determined on the basis of the standard pass schedule and therefore it can be roughly controlled. However, it is disadvantageous that the width variation due to external disturbance during operation can not be controlled and the scattered variation of the individual plates can be subjected only to the average control.

The present invention has been made in view of the above drawbacks and an object of the present invention is to provide a method of controlling an edging opening in which even if there are external disturbances and scattered variations of the individual plates, the exact control corresponding to the variation can be attained and a desired shape of rolled plate without the deformation can be fed.

The object of the present invention is achieved by the method of controlling an edging opening in a rolling mill, characterized by measuring a width distribution of a plate to be rolled at an inlet of an edging roll in the rolling mill, calculating an optimum edging opening variation distribution on the basis of a predetermined pass schedule, a target width deviation distribution of the rolled plate required at an outlet of the rolling mill and the width distribution of the plate to be rolled at the inlet of the edging roll, and supplying the optimum edging opening variation distribution to an edging opening setting unit for the feedforward control.

The present invention will be apparent from the following detailed description taken in conjunction with the accompanying drawings showing an edging opening control apparatus in a rolling mill according to an embodiment of the present invention.

FIG. 1 is a block diagram showing a preferred embodiment of the edging opening control apparatus which implements the method of controlling the edging opening in the rolling mill according to the present invention;

FIGS. 2(A), (B) and (C) are cross-sectional views of a material to be rolled before the rolling process, after passing through the edging roll and after passing through a horizontal roll, respectively; and FIG. 3 is a plan view schematically illustrating the change of the shape of the rolled material in the rolling process.

In FIG. 1, reference numeral 1 denotes an edging roll and numeral 2 a horizontal roll. A plate 3 to be rolled first passes through the edging roll 1 and then through the horizontal roll 2 so that the plate 3 is rolled to a desired shape and fed to the succeeding rolling process (not shown) for finishing. A width measuring device 4 is provided at an inlet of the edging roll 1 and adjacent to the edging roll 1 so that the width of the plate 3 before entering the edging roll 1 is measured and the width distribution $W_0(x)$ of the plate 3 is obtained (where x is a distance from the leading edge of the plate). A width deviation distribution $\Delta W_0(x)$ which is the difference between the width distribution $W_0(x)$ and a target value $W_0$ of the plate width at the inlet is stored in a width deviation memory 5 and then supplied to a computer 7 after a time delay by a time lag device 6. The time delay is used to control the timing so that a point at which the width data has been stored in the width variation memory 5 is produced when passing through the edging roll 1.

On the other hand, a higher rank computer (not shown) or the like previously determines a pass schedule value 8, that is, the target value $W_0$ of the plate width at the inlet, the edging opening setting value $W_1$, a plate width $W_2$ on the supposition that only dogbones (swelling at ends of the plate) produced in the edging rolling process are horizontally rolled and a plate width $W_3$ after horizontal rolling to supply them to the computer 7. Further, the computer 7 is supplied with a target width deviation distribution ($\Delta W_3(x)$) 9 required at the outlet of the rolling mill.

The computer 7 calculates an optimum edging opening variation quantity distribution $\Delta W_1(x)$ using the width variation distribution $\Delta W_0(x)$ on the basis of a predetermined equation to obtain the target width variation distribution $\Delta W_3$ after horizontal rolling. At this time, the distribution (equations (1)–(4)) of the irregular deformation quantity in the moving direction of the plate produced in the horizontal rolling process, the corresponding length of the plate in the moving direction (equations (5)–(8)) and the plate width adjustment efficiency distribution $\eta(x)$ in the moving direction at the irregular deformation portion (equations (9) and (10)) are calculated and the optimum edging opening variation quantity distribution $\Delta W_1(x)$ (equation (11)) is calculated on the basis of the above calculated values. The optimum edging opening variation quantity $\Delta W_1(x)$ is supplied to the edging opening setting unit 10 for the feedforward control to control the edging opening.

The irregular deformation portion at the leading edge, the regular deformation portion and the irregular deformation portion at the trailing edge are represented by reference letter a, b and c in FIG. 1, respectively. Reference letter w in FIG. 1 represents an output curve of the width measuring device 4.

The equations calculated by the computer 7 will now be described. Hereinafter, suffixes T and B represent the leading edge and the trailing edge of the plate, respectively, and the suffixes V and H represent the edging and the horizontal rolling, respectively.

When the edging rolling and the dogbone rolling are carried out, the width deviation $\Delta W_{TV}$ produced at the leading edge of the plate and the width deviation $\Delta W_{B'V}$ produced at the trailing edge of the plate are given by the following equations, respectively.

$$\Delta W_{T,V} = K_{T2} \cdot \left\{ 1 - \frac{C_T}{3 + \frac{(W_0 - W_1)}{t_0}} \right\} \cdot L_T + \Delta B_E \quad (1)$$

$$\Delta W_{B,V} = K_{B2} \cdot \left\{ 1 - \frac{C_B}{3 + \frac{(W_0 - W_1)}{t_0}} \right\} \cdot L_B + \Delta B_E \quad (2)$$

When the horizontal rolling is carried out, the width deviation distribution $\Delta W_{TH}(x)$ produced at the leading edge and the width deviation distribution $\Delta W_{B'H}(x)$ produced at the trailing edge are given by the following equations, respectively.

$$\Delta W_{T,H}(x) = K_{T4} \cdot \left( 1 - \frac{x}{l_T} \right)^{\zeta} \cdot g(r_H) \quad (3)$$

$$\Delta W_{B,H}(x) = K_{B4} \cdot \left( 1 - \frac{x}{l_B} \right)^{\zeta} \cdot g(r_H) \quad (4)$$

where $K_{T2}$, $K_{B2}$, $K_{T4}$, $K_{B4}$: constant determined by plate material $C_T$, $C_B$: constant $W_0$: plate width at inlet before rolling $W_1$: edging opening setting quantity $t_0$: plate thickness $L_T$, $L_B$: length of width reduction portion $\Delta B_E$: width restoration quantity of regular deformation portion by dogbone rolling (refer to FIG. 2)

x: distance from leading edge of plate $l_T$, $l_B$: length of width increasing portion $\zeta$: constant $r_H$: horizontal rolling ratio $g(r_H)$: function having a variable of horizontal rolling ratio $r_H$ The lengths $L_T$, $L_B$ of the width reduction portion and the lengths $l_T$, $l_B$ of the width increasing portion at the irregular deformation portion are calculated on the basis of the following equations.

$$L_T = K_{T1} \cdot \left\{ a_{T1} - a_{T2} \cdot \frac{(W_0 - W_1)}{l_d} \right\}^{\gamma} \cdot t_0^{k} \cdot W_1^{\delta} \times \left\{ 1 + e_T \cdot \frac{(W_0 - W_1)}{W_0} \right\} \quad (5)$$

$$L_B = K_{B1} \cdot \left\{ a_{B1} - a_{B2} \cdot \frac{(W_0 - W_1)}{l_d} \right\}^{\gamma} \cdot t_0^{k} \cdot W_1^{\delta} \times \left\{ 1 + e_T \cdot \frac{(W_0 - W_1)}{W_0} \right\} \quad (6)$$

-continued $$l_T = K_{T3} \cdot W_0^{\beta T} \quad (7)$$

$$l_B = K_{B3} \cdot W_0^{\beta B} \quad (8)$$

where $K_{T1}$, $K_{B1}$, $K_{T3}$, $K_{B3}$: constant determined by plate material $a_{T1}$, $a_{T2}$, $a_{B1}$, $a_{B2}$, $e_T$, $\gamma$, k, $\delta$, $\beta_T$, $\beta_B$: constant $l_d$: roll contact projection length $$l_d = \sqrt{D_E \cdot \frac{(W_0 - W_1)}{2}}$$

$D_E$: diameter of edging roll

The plate width adjustment efficiency distribution $\eta_T(x)$ at the leading edge of the plate and the plate width adjustment efficiency distribution $\eta_B(x)$ at the trailing edge of the plate are calculated from $\Delta W_{TV}$ and $\Delta W_{B'V}$ on the basis of the following equations.

$$\eta_T(x) = \eta_0 + f(x) \cdot \frac{\Delta W_{T,V}}{(W_0 - W_1)} \quad (9)$$

$$\eta_B(x) = \eta_0 + f(x) \cdot \frac{\Delta W_{B,V}}{(W_0 - W_1)} \quad (10)$$

where f(x): distribution curve of the width reduction upon edging and dogbone rolling $\eta_0$: plate width adjustment efficiency at regular deformation portion The optimum edging opening variation quantity distribution $\Delta W_1(x)$ is calculated from the plate width adjustment efficiency distributions $\eta_T(x)$ and $\eta_B(x)$ at the leading edge and the trailing edge, respectively, on the basis of the following equation.

(i) In $0 \leqq X \leqq l_t$: $\Delta W_2(X) = \Delta W_3(X) - \Delta W_{T.H}(X)$ (ii) In $l_T < X <$ total length $- l_B$: $\Delta W_2(X) = \Delta W_3(X)$ (iii) In total length $- l_B \leqq X \leqq$ total length: $\Delta W_2(X) - \Delta W_3(X) - \Delta W_{B.H.}(X)$ $$\Delta W_1(x) = K_0 \cdot \left( 1 - \frac{\eta_0}{\eta(x)} \right) \cdot (W_0 - W_1) + K_1 \cdot \left\{ \Delta W_0(x) - \frac{(\Delta W_0(x) - \Delta W_2(x))}{\eta(x)} \right\} \quad (11)$$

where $\Delta W_2(x)$: target width deviation distribution after dogbone rolling $K_0$, $K_1$: constant $\Delta W_1(x)$ at the leading edge of the plate is obtained by substituting $\eta_T(x)$ for $\eta(x)$ and $\Delta W_1(x)$ at the trailing edge of the plate is obtained by substituting $\eta_B(x)$ for $\eta(x)$.

Further, the following relations are satisfied among $\Delta W_2(x)$, $\Delta W_3(x)$, $\Delta W_{TH}(x)$ and $\Delta W_{B'H}(x)$.

(i) In $0 \leqq x \leqq l_T$: $\Delta W_2(x) = \Delta W_3(x) - \Delta W_{TH}(x)$ (ii) In $l_T < x <$ total length $- l_B$: $\Delta W_2(x) = \Delta W_3(x)$ (iii) In total length $- l_B \leqq x \leqq$ total length: $\Delta W_2(x) = \Delta W_3(x) - \Delta W_{B'H}(x)$ In accordance with the series of equations described above, the irregular deformation at the leading and trailing edges of the plate due to the rolling operation is divided into the width reduction deformation by the edging and the plectrum-like deformation by the horizontal rolling to calculate beforehand the quantity and the length thereof. The edging opening setting quantity optimum for the individual plates can be calculated using the above-calculated value. Therefore, the exact calculation can be attained while following the rolling condition closely.

The edging opening control method according to the present invention comprises measuring the width of the rolled plate, determining the edging opening setting quantity using a predetermined calculation equation on the basis of the measured value, and supplying the setting quantity to the edging opening setting unit for the feedforward control. Therefore, the edging opening control can be made with higher accuracy while coping with the external disturbance or the variations of the shape of the plate due to the scattering of the extraction temperature from a furnace and the rolling setting quantity.

Further, while the shape of the plate required at the outlet of the rolling mill is not limited to a square when taking the width variation in the succeeding rolling process for finishing into consideration, a desired plane-shaped plate other than a square can be also rolled since the edging opening variation quantity distribution is calculated from the target width deviation distribution of the rolled plate at the outlet of the rolling mill and the measured width deviation distribution.

Since the width variation at the regular deformation portion can be also treated with, the width deviation distribution at the regular deformation portion can be removed.

What is claimed is:

1. A method of controlling an edging opening in a rolling mill including an edging roll having an inlet and a feedforward control for controlling the edging opening followed by a horizontal roll and then by a succeeding rolling process for finishing, comprising the steps of (i) measuring a width distribution $W_0(X)$ along the full length of a material to be rolled having a leading end part, a trailing end part and an intermediate part extending between the leading end and a trailing end part and effecting the measuring adjacent to and upstream from the inlet of the edging roll from the leading end to the trailing end, (ii) calculating an optimum edging opening variation quantity distribution $\Delta W_1(x)$ from a predetermined pass schedule, a target width deviation distribution $\Delta W_3(x)$ of the rolled material required at an outlet of the rolling mill and the width distribution $W_0(x)$ of the rolled material measured at the inlet of the edging roll, and (iii) supplying the optimum edging opening variation quantity distribution to an edging opening setting unit for the feedforward control, said pass schedule for calculating the optimum edging opening variation quantity distribution $\Delta W_1(x)$ includes a target plate width value $W_0$ at the inlet, an edging opening setting value $W_1$, a plate width $W_2$ on the supposition that only dogbones or swelling at the ends of the plate produced in the edging rolling process are horizontally rolled, and a plate width $W_3$ after horizontal rolling, said step of calculating said optimum edging opening variation quantity distribution $\Delta W_3(x)$ comprises steps of:

calculating a width deviation distribution in a moving direction of the plate at an irregular deformation portion produced in the rolling process and a corresponding length of the plate in the moving direction, calculating a plate width adjustment efficiency on the basis of the calculated values of the width deviation distribution and the length of the plate in the moving direction, and calculating an optimum edging opening variation distribution using the plate width adjustment efficiency, said step of calculating the width deviation distribution in the moving direction of the plate at the irregular deformation portion produced in the rolling process includes the following calculations:

when edging rolling and dogbone rolling are carried out, a width deviation $\Delta W_{TV}$ produced at the leading edge of the plate and a width deviation $\Delta W_{B'V}$ produced at the trailing edge of the plate are given by $$\Delta W_{T,V} = K_{T2} \cdot \left\{ 1 - \frac{C_T}{3 + \frac{(W_0 - W_1)}{t_0}} \right\} \cdot L_T + \Delta B_E \tag{1}$$

$$\Delta W_{B,V} = K_{B2} \cdot \left\{ 1 - \frac{C_B}{3 + \frac{(W_0 - W_1)}{t_0}} \right\} \cdot L_B + \Delta B_E \tag{2}$$

when horizontal rolling is carried out, a width deviation distribution $\Delta W_{TH}(x)$ produced at the leading edge of the plate and a width deviation distribution $\Delta W_{B'H}(x)$ produced at the trailing edge of the plate are given by $$\Delta W_{T,H}(x) = K_{T4} \cdot \left(1 - \frac{x}{l_T}\right)^{\zeta} \cdot g(r_H) \tag{3}$$

$$\Delta W_{B,H}(x) = K_{B4} \cdot \left(1 - \frac{x}{l_B}\right)^{\zeta} \cdot g(r_H) \tag{4}$$

where $K_{T2}$, $K_{B2}$, $K_{T4}$, $K_{B4}$: constant determined by plate material $C_T$, $C_B$: constant $W_0$: plate width at inlet before rolling $W_1$: edging opening setting quantity $t_0$: plate width $L_T$, $L_B$: length of width reduction portion $\Delta B_E$: width restoration quantity of regular deformation portion by dogbone rolling x: distance from leading edge of plate $l_T$, $l_B$: length of width increasing portion $\zeta$: constant $r_H$: horizontal rolling ratio $g(r_H)$: function having variable of horizontal rolling ratio $r_H$, said step of calculating the length in the moving direction of the plate at the irregular deformation portion produced in the rolling process includes the following calculations:

lengths $L_T$ and $L_B$ of the width reduction portion and lengths $l_T$ and $l_B$ of the width increasing portion at the irregular deformation portion are calculated in accordance with the following equations:

$$L_T = K_{T1} \cdot \left\{ a_{T1} - a_{T2} \cdot \frac{(W_0 - W_1)}{l_d} \right\}^{\gamma} \cdot t_0^k \cdot W_1^{\delta} \times \left\{ 1 + e_T \cdot \frac{(W_0 - W_1)}{W_0} \right\} \quad (5)$$

$$L_B = K_{B1} \cdot \left\{ a_{B1} - a_{B2} \cdot \frac{(W_0 - W_1)}{l_d} \right\}^{\gamma} \cdot t_0^k \cdot W_1^{\delta} \times \left\{ 1 + e_T \cdot \frac{(W_0 - W_1)}{W_0} \right\} \quad (6)$$

$$l_T = K_{T3} \cdot W_0^{\beta T} \quad (7)$$

$$l_B = K_{B3} \cdot W_0^{\beta B} \quad (8)$$

where $K_{T1}$, $K_{B1}$, $K_{T3}$, $K_{B3}$: constant determined by plate material $a_{T1}$, $a_{T2}$, $a_{B1}$, $a_{B2}$, $e_T$, $\gamma$, k, $\delta$, $\beta_T$, $\beta_B$: constant ld: roll contact projection length $$l_d = \sqrt{D_E \cdot \frac{(W_0 - W_1)}{2}}$$

$D_E$: diameter of edging roll, said step of calculating the plate width adjustment efficiency on the basis of the calculated values of the width deviation distribution and the length in the moving direction of the plate includes the following calculations:

plate width adjustment efficiency distribution $\eta_T(x)$ and $\eta(x)$ at the leading edge and the trailing edge of the plate, respectively, are calculated by the following equations from the above $\Delta W_T$, V and $\Delta W_{B'V}$:

$$\eta_T(x) = \eta_0 + f(x) \cdot \frac{\Delta W_{T,V}}{(W_0 - W_1)} \quad (9)$$

$$\eta_B(x) = \eta_0 + f(x) \cdot \frac{\Delta W_{B,V}}{(W_0 - W_1)} \quad (10)$$

where f(x) is a distribution curve of the width reduction upon edging and dogbone rolling, and $\eta_0$ is plate width adjustment efficiency at regular deformation portion.

2. A method according to claim 1, wherein said step of calculating the optimum edging opening variation distribution using the plate width adjustment efficiency includes the following calculation:

the optimum edging opening variation quantity distribution $\Delta W_1(x)$ is calculated from the plate width adjustment efficiency distributions $\eta_T(x)$ and $\eta_B(x)$ at the leading and trailing edge of the plate on the basis of the following equation:

$$\Delta W_1(x) = K_0 \cdot \left( 1 - \frac{\eta_0}{\eta(x)} \right) \cdot (W_0 - W_1) + K_1 \cdot \left\{ \Delta W_0(x) - \frac{(\Delta W_0(x) - \Delta W_2(x))}{\eta(x)} \right\} \quad (11)$$

where $\Delta W_2(x)$: target width deviation distribution after dogbone rolling $K_0$, $K_1$: constant $\Delta W_1(x)$ at the leading edge of the plate is obtained by substituting $\eta_T(x)$ for $\eta(x)$ and $\Delta W_1(x)$ at the trailing edge of the plate is obtained by substituting $\eta_B(x)$ for $\eta(x)$, the following relations are satisfied among $\Delta W_2(x)$, $\Delta W_3(x)$, $\Delta W_{TH}(x)$ and $\Delta W_{B'H}(x)$, (i) In $0 \leqq x \leqq l_T$: $\Delta W_2(x) = \Delta W_3(x) - \Delta W_{TH}(x)$ (ii) In $l_T < x <$ total length $- l_B$: $\Delta W_2(x) = \Delta W_3(x)$ (iii) In total length $- l_B \leqq x \leqq$ total length: $\Delta W_2(x) = \Delta W_3(x) - \Delta W_{B'H}(x)$.

* * * * *